US007721490B1

(12) United States Patent
Cerula

(10) Patent No.: US 7,721,490 B1
(45) Date of Patent: May 25, 2010

(54) SYSTEM AND METHOD FOR INSTALLING A BASE FOR A ROADSIDE UTILITY POLE

(76) Inventor: Michael W. Cerula, 100 Pike Rd., Bldg "B", Mount Laurel, NJ (US) 08054

( * ) Notice: Subject to any disclaimer, the term of this patent is extended or adjusted under 35 U.S.C. 154(b) by 684 days.

(21) Appl. No.: 11/234,621

(22) Filed: Sep. 26, 2005

(51) Int. Cl.
*E04B 1/00* (2006.01)

(52) U.S. Cl. ..... 52/98; 52/169.9; 52/736.1

(58) Field of Classification Search ..... 248/156, 248/158, 511, 512; 52/292, 296, 736.1, 736.4, 52/98, 169.9; 249/210
See application file for complete search history.

(56) References Cited

U.S. PATENT DOCUMENTS 3,521,413 A * 7/1970 Scott et al. ..... 52/98
3,630,474 A * 12/1971 Minor ..... 52/98
3,963,210 A * 6/1976 Macklin ..... 249/210
4,007,564 A * 2/1977 Chisholm ..... 52/98
4,716,696 A * 1/1988 Yacoboni ..... 52/169.9
6,302,824 B1 * 10/2001 MacAdam et al. ..... 482/37
6,820,389 B1 * 11/2004 Macchietto ..... 52/736.1
6,868,641 B2 * 3/2005 Conner et al. ..... 52/98
6,910,826 B1 * 6/2005 Damiano ..... 403/2

* cited by examiner

*Primary Examiner*—A. Joseph Wujciak, III
*Assistant Examiner*—Todd M. Epps
(74) *Attorney, Agent, or Firm*—LaMorte & Associates

(57) ABSTRACT

A system and method for creating a pole support base for the installation of a road-side pole. A mounting head assembly is provided. Support legs extend from the bottom surface of the mounting head assembly and support the mounting head assembly at a predetermined height that can be selectively adjusted. Pole mounts are provided on the top surface of the mounting head assembly that enable the base of a pole to be bolted to the mounting head assembly. A hole is excavated in the place where the pole is to be erected. The mounting head assembly is placed into the hole. The legs support the mounting head assembly within the hole and enable the mounting head assembly to be adjusted for height and levelness. The hole is then filled with poured concrete until at least the legs are submersed.

7 Claims, 4 Drawing Sheets

SYSTEM AND METHOD FOR INSTALLING A BASE FOR A ROADSIDE UTILITY POLE

BACKGROUND OF THE INVENTION

1. Field of the Invention

In general, the present invention relates to the underground support bases for roadside poles, such as street light poles and sign poles. More particularly, the present invention relates to the structure of such support bases and the methods by which such support bases are created and installed.

2. Description of the Prior Art

There are many poles that stand on the sides of various roadways. Some poles are merely stands that support signs or utility wires above the ground. Other poles, such as poles for street lights, illuminated signs and traffic lights receive underground power cables, therein providing electrical power to the supported signs.

Most every state has standards regarding the size, shape and construction of the support base for roadside poles, especially those that receive power cables. A typical pole base specification requires that the pole base be fabricated from poured concrete in a pier that is about 70 inches deep and 42 inches square. Such dimensions require the pouring of at least two cubic yards of concrete.

Such prior art pole base supports are exemplified in U.S. Pat. No. 3,630,474, to Minor, entitled Breakaway Pole Support And Structure. In the construction of such a prior art pole support base, a large hole must be excavated on the side of a roadway. A large monolithic foundation is then poured into the bottom of the excavated hole. A smaller cement mounting head section is then formed atop the below-grade foundation. The smaller mounting head section extends upwardly from the foundation to a point above grade. The base of a street pole attaches to the top of the mounting head section. Anchor bolts extend from the top of the mounting head section to enable a street pole to be attached to the base support. Furthermore, a conduit protrudes out of the top of the mounting head section so that an electrical cable can be passed into a street pole through the structure of the base support.

In order to properly form such a prior art pole support base, the anchor bolts and the cable conduit must be set in precise positions before they are encased in concrete. If an anchor bolt or cable conduit is misaligned, the pole support base will require repairs before a street pole can be mounted. Typically, such prior art pole bases are manufactured on site along the side of a road. To create such a pole base, a large hole must be excavated. A form is then set into the elevated hole. The anchor bolts and power cable conduit are set into the form using wires and positioning templates. Once the form is constructed and the bolts and conduit set in position, then form is the filled with concrete. The concrete is given time to cure. Finally, the form is broken away from the cured concrete and the remainder of the excavated hole is backfilled with dirt. As can be understood, the forming of a pole support base in such a manner is a very time consuming and labor intensive procedure. Furthermore, should an anchor bolt shift while the form is being filled, the anchor bolt many not align with the mounting holes of the pole being installed. Time consuming repairs must then be performed.

A need therefore exists for a system and method for installing a pole support base that greatly reduces the time and labor needed to set a pole base in place. A need also exists for a new system and method of installing a pole support that ensures that the pole support presents mounting bolts that are properly positioned and level, thereby reducing the need for repairs. These needs are met by the present invention as described and claimed below.

SUMMARY OF THE INVENTION

The present invention is a system and method for creating a pole support base for the installation of a road-side pole. A mounting head assembly is provided that has a top surface and a bottom surface. Support legs extend from the bottom surface of the mounting head assembly and support the mounting head assembly at a predetermined height that can be selectively adjusted. Pole mounts are provided on the top surface of the mounting head assembly that enable the base of a pole to be bolted to the mounting head assembly.

A hole is excavated in the place where the pole is to be erected. The mounting head assembly is placed into the hole. The legs support the mounting head assembly at a predetermined height within the hole and enable the mounting head assembly to be adjusted for height and levelness. The hole is then filled with poured concrete until at least the legs are submersed.

Since the pole mounts are prefabricated as part of the mount head assembly, the positions of the pole mounts are fixed and do not move during the construction of the pole support base. Consequently, provided that the mounting head assembly can be placed at the proper depth in a hole and can be leveled, a proper pole mounting base can be quickly and inexpensively constructed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention system and method can be used to create the support base for many types of poles, such as sign poles, the present invention is especially well suited for the creation of support bases for roadside poles that receive electricity via a cable that passes through the support base. Accordingly, the exemplary embodiment of the present invention will set forth a pole support base that contains a conduit for the passage of an electric cable. Such an embodiment is merely exemplary of the best mode contemplated for the invention and should not be considered a limitation to the present invention.

Figure 1:
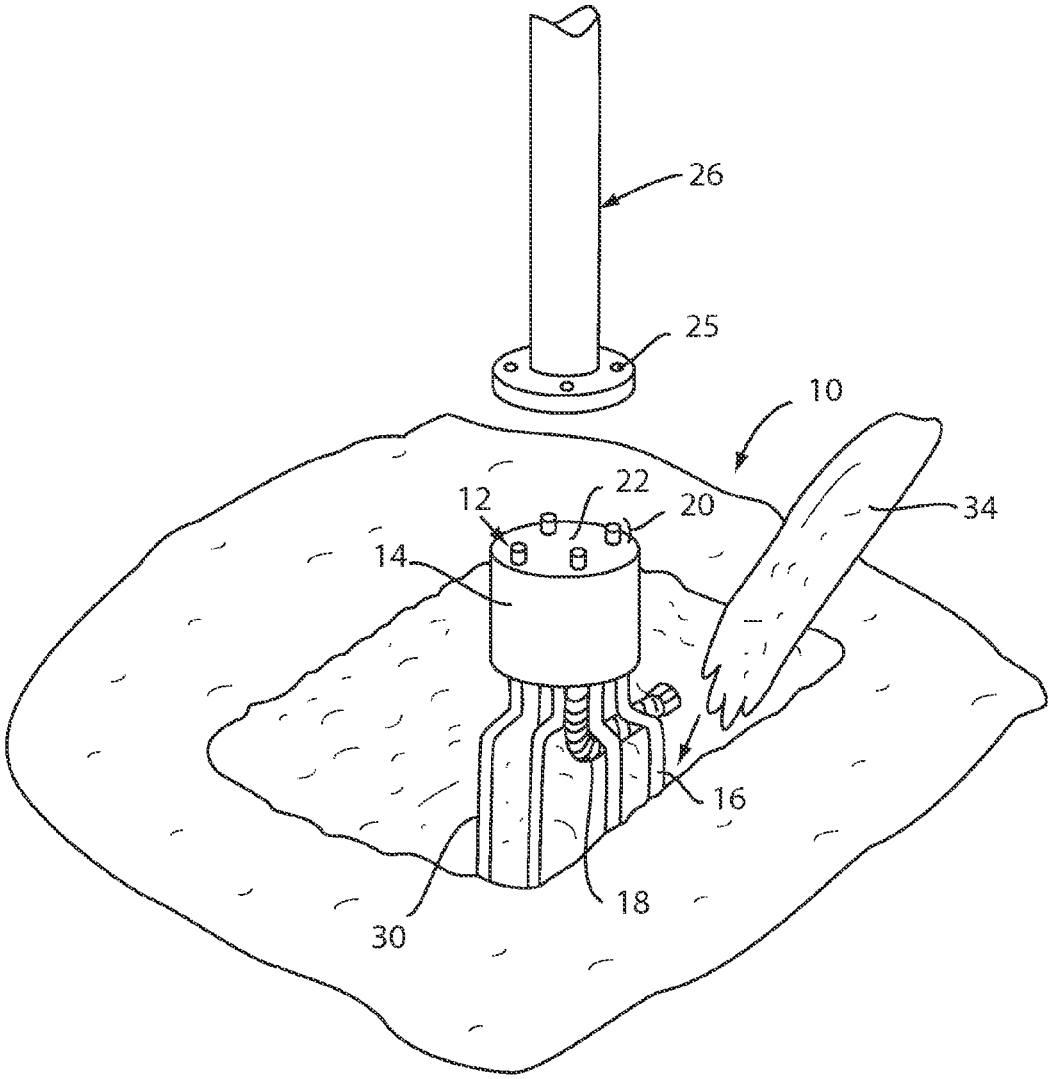
FIG. 1 is an exploded view of an exemplary embodiment of a pole support base shown in conjunction with a street pole and an excavated hole.
Figure 2:
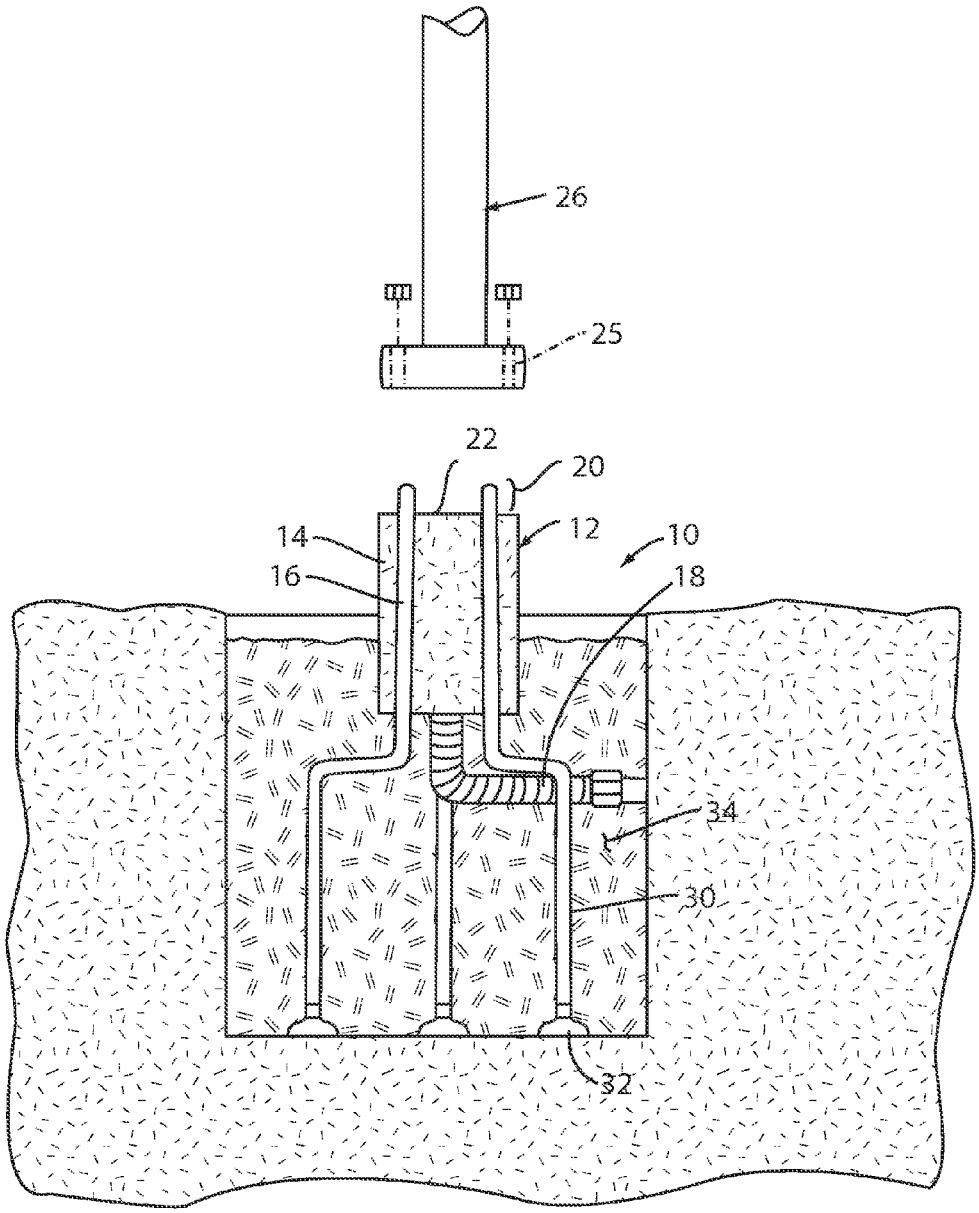
FIG. 2 is a cross-sectional view of the embodiment of FIG. 1.

Referring to both FIG. 1 and FIG. 2, there is shown an exemplary pole base support 10. The pole base support 10 contains a prefabricated subassembly 12. The prefabricated subassembly 12 is manufactured off-site and is brought to the site of the pole base support 10 as a completed unit. The prefabricated subassembly 12 is comprised of a concrete mounting head 14 that has been precisely cast. The concrete mounting head 14 is formed around sections of anchor elements 16 and a section of a cable conduit 18. The position of the anchor elements 16 and the cable conduit 18 are precisely maintained during the manufacturing of the prefabricated subassembly 12. Accordingly, the positions of the anchor elements 16 and the cable conduit 18 can be precisely controlled and cannot be inadvertently altered on the site of the installation of the pole base support 10.

In the shown embodiment, the anchor elements 16 terminate at one end with pole mounts 20. The pole mounts 20 extend above the top surface of the precast concrete mounting head 14. The pole mounts 20 are located at precise positions that correspond to the mounting holes 25 in the base of the pole 26 being erected. In this manner, when a pole 26 is placed upon the top surface 22 of the precast concrete mounting head 14, the mounting holes 25 of the pole 26 will align exactly with the pole mounts 20 protruding from the top surface 22. It will be understood that the male mounting bolt configuration shown in FIG. 1 can be replaced with female threaded bores that receive bolts. The use of either a male bolt or a female threaded bore is a manner of design choice that may vary from state to state. What is of importance is that some type of precisely positioned pole mounts 20 are accessible on the top surface 22 of the precast concrete mounting head 14 and that the position of the pole mounts align with the mounting holes 25 of the pole 26 being erected.

Anchor elements 16 extend below the concrete mounting head 14. The segments of the anchor elements 16 that protrude below the concrete mounting head 14 are configured as support legs 30. The support legs 30 are symmetrically positioned about the concrete mounting head 14 so as to support the concrete mounting head 14 at a predetermined height. Preferably, there are at least three support legs 30 formed by the anchor elements 16. In this manner, the support legs 30 can form a stable platform and can enable the concrete mounting head 14 to be free standing.

The anchor elements 16 that form the support legs 30 can terminate within the concrete mounting head 14. However, in the shown embodiment, each anchor element 16 has two ends. The top end of each of the anchor elements 16 is formed to create the pole mounts 20 that extend out of the top surface 22 of the concrete mounting head 14. The bottom end of each of the same anchor elements 16 extends from the bottom surface 23 of the concrete mounting head 14 and becomes one of the support legs 30. It will be understood that with the pole mounts 20 and the support legs 30 being opposite ends of common anchor elements 16, the pole mounts 20 cannot be separated from the support legs 30, even if the concrete mounting head 14 were to crack. However, having the pole mounts 20 and the support legs 30 as part of common anchor elements 16 is merely a preferred embodiment and it will be understood that the present invention can be constructed where both the pole mounts 20 and the support legs 30 are separate elements.

The bottom of each of the support legs 30 preferably terminates with a threaded leveling pad 32. The leveling pads 32 are used to adjust the effective length of each of the support legs 30. Furthermore, the leveling pads 32 are wider than the support legs 30 and prevent the support legs 30 from descending into the dirt at the bottom of an excavated hole. Accordingly, the leveling pads 32 are used to both stabilize and level the prefabricated subassembly 12, as will later be explained.

A volume of poured concrete 34 surrounds the support legs 30. The poured concrete 34 also envelops part of the precast concrete mounting head 14. Accordingly, when the volume of poured concrete 34 is cured, it will be understood, that the prefabricated subassembly 12 is fixed within the poured concrete 34 and cannot be moved independently.

Figure 3:
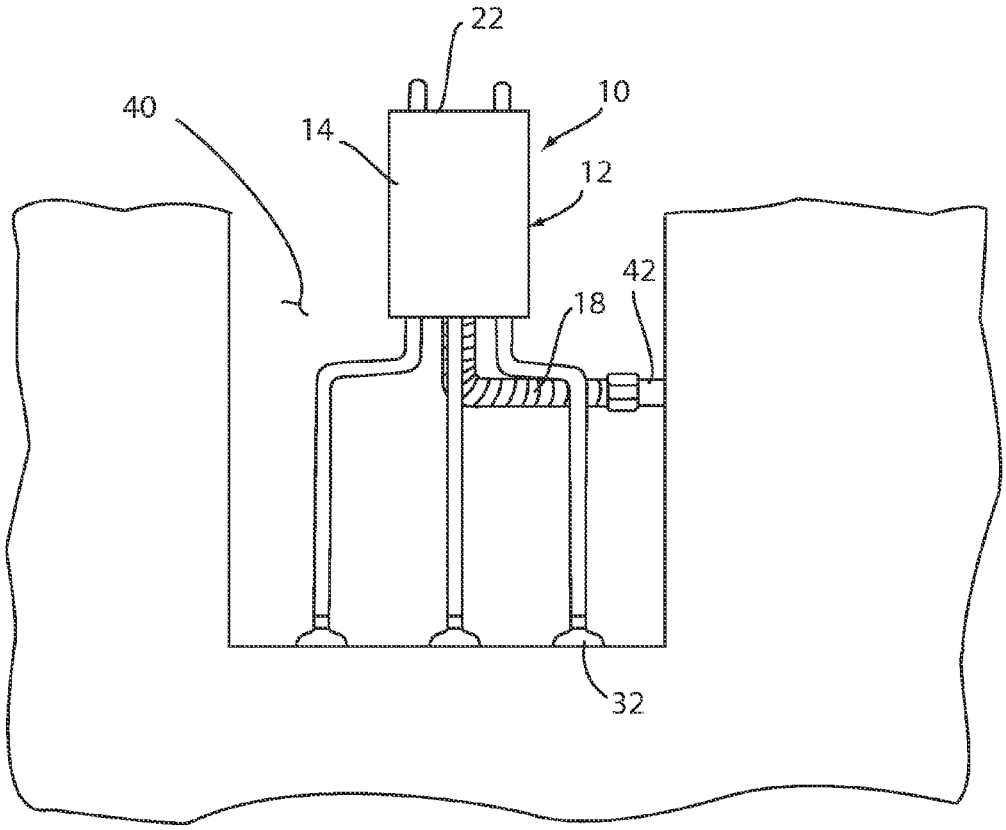
FIG. 3 is a side view of the prefabricated subassembly used to illustrate the initial steps involved in forming the present invention pole support base.

Referring to FIG. 3, the method of construction for the pole base support 10 can be initially described. A hole 40 is excavated in the ground. The hole 40 is preferably forty-two inches square and about four feet deep. This is much smaller than the holes needed for prior art pole base supports, because there is no need to excavate additional room for concrete forms. Rather, the excavated hole 40, itself, serves as the concrete form, as will later become apparent.

The prefabricated subassembly 12 is placed within the excavated hole 40. The support legs 30 of the prefabricated subassembly 12 rest upon the bottom of the excavated hole 40. The leveling pads 32 are adjusted so that the top surface 22 of the concrete mounting head 14 lay flat in the horizontal plane. The leveling pads 32 are also used to raise and lower the prefabricated subassembly 12 so that the top surface 22 of the concrete mounting head 14 extends above the grade of the ground.

The flexible cable conduit 18 is bent to the side of the excavated hole 40. If the supply conduit has yet to be run to the excavated hole 40, a small side hole can be hand dug and the flexible conduit 40 pulled into this side hole. This will protect the end of the flexible conduit 18 from becoming encased in concrete as the excavated hole 40 is filled. If a supply conduit 42 is present, as is shown, the flexible cable conduit 18 can be attached directly to the incoming supply conduit 42.

Figure 4:
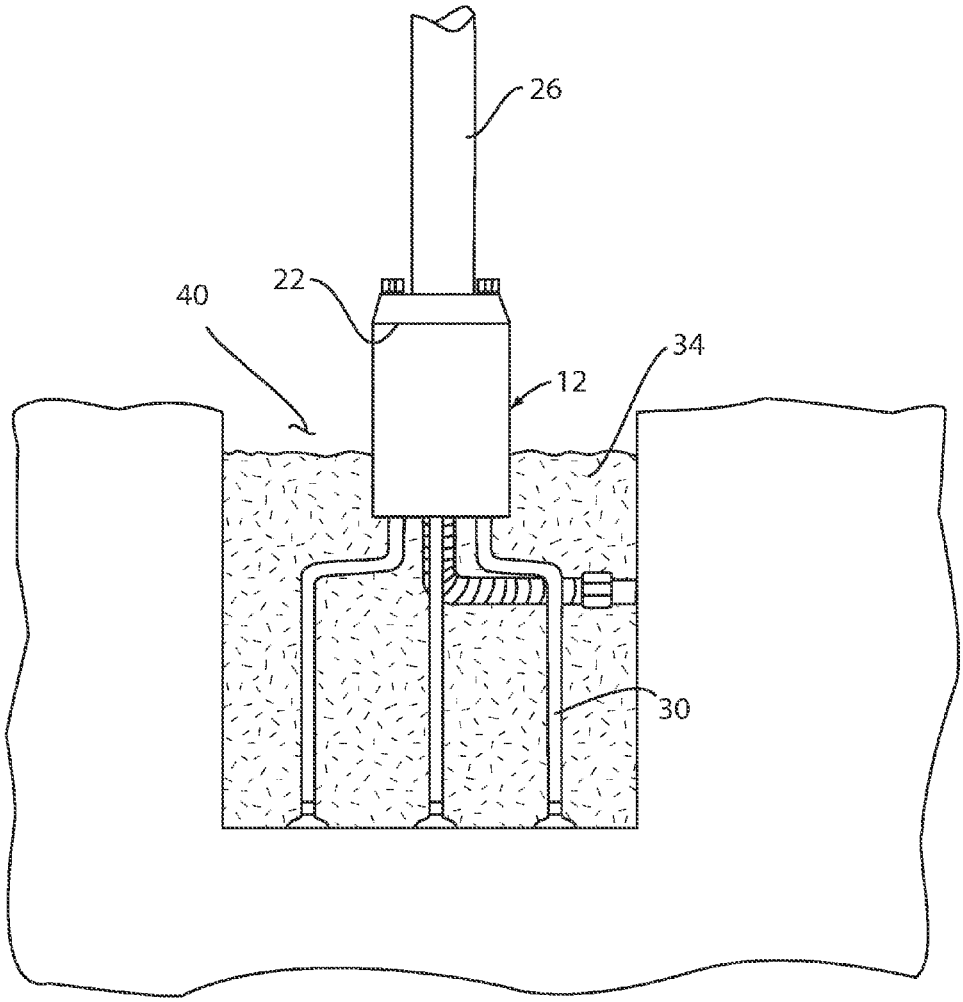
FIG. 4 is a side view of the prefabricated subassembly used to illustrate the final steps involved in forming the present invention pole support base.

Referring to FIG. 4, it can be seen that once the prefabricated subassembly 12 is set in place and leveled, the excavated hole 40 is filled with poured concrete 34 to a depth of at least three feet. At his depth, the concrete rises in the hole 40 to a level approximately one-third up the length of the concrete mounting head 14. The volume of concrete being poured is between 20 percent and 40 percent less than that required by many prior art pole supports.

As the poured concrete 34 hardens, the support legs 30 within the poured concrete act as reinforcement rods to the concrete. Once the concrete is cured, the support legs 30 are encased within the concrete and the precast concrete mounting head 14 becomes permanently affixed to the concrete base. Only a small area around the concrete mounting head 14 remains needing to be backfilled to ground grade level.

The pole 26 can then be attached to the top surface 22 of the concrete mounting head 14 in a traditional manner. Since the spacing of the pole mounts 20 on the top surface 22 of the concrete mounting head 14 is unaffected by on-site construction, the positions of the pole mounts 20 remains unchanged and precisely align with the mounting holes 25 on the pole 26 being installed.

By using the prefabricated subassembly 12, the need to set forms in an excavated hole 40 is eliminated. The excavated hole 40 can therefore be quickly created. The prefabricated subassembly 12 has the ability to be leveled. Thus, the excavated hole 40 need not be leveled or otherwise prepped once dug.

It will be understood that the embodiment of the present invention pole support base is merely exemplary and that a person skilled in the art can make many variations to the shown embodiment using functionally equivalent components. For example, the number and shape of the legs is a matter of design choice. Furthermore, the size of the prefabricated subassembly and the excavated hole can be varied depending upon the size and weight of the pole that is being erected. All such variations, modifications and alternate embodiments are intended to be included within the scope of the present invention as described and claimed below.

What is claimed is:

1. A method of fabricating a pole support base, comprising the steps of:

providing a plurality of anchor elements, each of said anchor elements extending continuously between a first end and a second end, wherein a pole mount section is disposed on each of said anchor elements proximate said first end, and wherein a leg support section leads to said second end of each of said anchor elements; and partially encasing said anchor elements in a first body of concrete that has a top surface and a bottom surface, wherein said pole mount section of each of said anchor elements is exposed on said top surface, and said support leg section of each of said anchor elements extends from said bottom surface, therein supporting said first body of concrete at a predetermined height.

2. The method according to claim 1, further including the step of selectively adjusting said support leg section of each of said anchor elements to level said top surface of said first body of concrete.

3. The method according to claim 1, further including the step of creating a second body of concrete around each said support leg section and around a portion of said first body of concrete.

4. A method of creating a support base for a pole, comprising the steps of:

providing a plurality of anchor elements, each of said anchor elements extending continuously between a first end and a second end, wherein a pole mount section is disposed on each of said anchor elements proximate said first end, and wherein a leg support section leads to said second end of each of said anchor elements;

encasing portions of said plurality of anchor elements in concrete to create a mount head assembly having a top surface and a bottom surface, wherein said leg support section of each of said anchor elements extends from said bottom surface, and wherein each said pole mount section extends from said top surface;

excavating a hole;

placing said mount head assembly into said hole, wherein each said leg support section extending from said mount head assembly supports said mount body at a predetermined height within said hole; and filling said hole with poured concrete until at least each said leg support section is covered by the concrete within said hole.

5. The method according to claim 4, further including the step of adjusting each said leg support section provides a level support to said mount head assembly in said hole.

6. The method according to claim 4, further including the step of adjusting each said leg support section so that said top surface of said mount head assembly is supported above said hole.

7. The method according to claim 4, wherein said step of filling said hole with poured concrete includes filling said hole until the poured concrete reaches a height above said bottom surface of said mount head assembly.

* * * * *